US010361485B2

(12) United States Patent
Isom

(10) Patent No.: US 10,361,485 B2
(45) Date of Patent: Jul. 23, 2019

(54) TRIPOLE CURRENT LOOP RADIATING ELEMENT WITH INTEGRATED CIRCULARLY POLARIZED FEED

(71) Applicant: Raytheon Company, Waltham, MA (US)

(72) Inventor: Robert S. Isom, Allen, TX (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 15/731,906

(22) Filed: Aug. 4, 2017

(65) Prior Publication Data

US 2019/0044234 A1 Feb. 7, 2019

(51) Int. Cl.

| | |
|---|---|
| ***H01Q 11/12*** | (2006.01) |
| ***H01Q 7/00*** | (2006.01) |
| ***H01Q 21/24*** | (2006.01) |
| ***H01Q 21/00*** | (2006.01) |
| *H01Q 23/00* | (2006.01) |

(52) U.S. Cl.

CPC ..... *H01Q 7/005* (2013.01); *H01Q 21/0006* (2013.01); *H01Q 21/24* (2013.01); *H01Q 23/00* (2013.01)

(58) Field of Classification Search

CPC .... H01Q 7/005; H01Q 21/0006; H01Q 21/24; H01Q 23/00

USPC ..... 343/743

See application file for complete search history.

(56) References Cited

U.S. PATENT DOCUMENTS

| | | | |
|---|---|---|---|
| 2,015,028 | A | 9/1935 | Gillette |
| 3,414,892 | A | 12/1968 | McCormack et al. |
| 3,528,050 | A | 9/1970 | Hindenburg |
| 3,624,587 | A | 11/1971 | Conrad |

(Continued)

FOREIGN PATENT DOCUMENTS

| | | | |
|---|---|---|---|
| CN | 103247581 | A | 8/2013 |
| CN | 204857954 | U | 12/2015 |

(Continued)

OTHER PUBLICATIONS

Response to U.S. Non-Final Office Action dated Apr. 5, 2018 for U.S. Appl. No. 15/379,761, filed Aug. 1, 2018; 23 Pages.

(Continued)

*Primary Examiner* — Jean B Jeanglaude

(74) *Attorney, Agent, or Firm* — Daly, Crowley, Mofford & Durkee LLP

(57) ABSTRACT

In accordance with the concepts, systems, methods and techniques described herein a tripole current loop radiating element is provided having three conductors disposed on a substrate with the three conductors being physically spaced apart from each other and arranged to be responsive to radio frequency (RF) signals at a desired frequency range. Each of the three conductors includes a ground via to couple the respective conductor to a ground plane and a signal via to receive RF signals from a single feed circuit. The feed circuit includes a signal port, and first, second and third antenna ports, with each of the antenna ports coupled to a respective one of the three conductors. The feed circuit can provide the RF signals to each of the three conductors having equal amplitudes and distributed with relative phases of 0°/120°/240° respectively (i.e., phase shifted by 120° from an adjacent conductor).

22 Claims, 6 Drawing Sheets

(56) References Cited

U.S. PATENT DOCUMENTS 3,960,424 A 6/1976 Weisenburger
4,479,686 A 10/1984 Hoshino et al.
4,686,536 A 8/1987 Allcock
4,690,471 A 9/1987 Marabotto et al.
5,060,369 A 10/1991 Date
5,146,308 A 9/1992 Chance et al.
5,172,082 A 12/1992 Livingston et al.
5,244,395 A 9/1993 DeSantis et al.
5,338,207 A 8/1994 Lineberry et al.
5,355,283 A 10/1994 Marrs et al.
5,410,281 A 4/1995 Blum
5,434,575 A 7/1995 Jelinek et al.
5,453,751 A 9/1995 Tsukamoto et al.
5,455,546 A 10/1995 Frederick et al.
5,603,620 A 2/1997 Hinze et al.
5,644,277 A 7/1997 Gulick et al.
5,661,901 A 9/1997 King
5,745,079 A * 4/1998 Wang ..... H01Q 9/0414 343/700 MS
5,880,694 A * 3/1999 Wang ..... H01Q 9/0414 343/700 MS
5,886,590 A 3/1999 Quan et al.
5,938,455 A 8/1999 Glovatsky et al.
5,995,047 A 11/1999 Freyssinier et al.
6,100,775 A 8/2000 Wen
6,114,221 A 9/2000 Tonti et al.
6,114,997 A 9/2000 Lee et al.
6,147,648 A 11/2000 Granholm et al.
6,166,701 A 12/2000 Park et al.
6,184,832 B1 2/2001 Geyh et al.
6,307,160 B1 10/2001 Mei et al.
6,320,542 B1 11/2001 Yamamoto et al.
6,424,298 B1 7/2002 Nishikawa et al.
6,429,816 B1 8/2002 Whybrew et al.
6,459,415 B1 10/2002 Pachal et al.
6,512,487 B1 1/2003 Taylor et al.
6,664,867 B1 12/2003 Chen
6,686,885 B1 2/2004 Barkdoll et al.
6,822,617 B1 11/2004 Mather et al.
6,830,460 B1 12/2004 Rathburn
6,856,297 B1 2/2005 Durham et al.
6,867,742 B1 3/2005 Irion, II et al.
6,876,336 B2 4/2005 Croswell et al.
6,882,247 B2 4/2005 Allison et al.
6,891,511 B1 5/2005 Angelucci
6,935,866 B2 8/2005 Kerekes et al.
6,950,062 B1 9/2005 Mather et al.
6,977,623 B2 12/2005 Durham et al.
7,012,572 B1 3/2006 Schaffner et al.
7,084,827 B1 8/2006 Strange et al.
7,113,142 B2 9/2006 McCarville et al.
7,132,990 B2 11/2006 Stenger et al.
7,138,952 B2 11/2006 Mcgrath et al.
7,193,490 B2 3/2007 Shimoda
7,221,322 B1 5/2007 Durham et al.
7,272,880 B1 9/2007 Pluymers et al.
7,315,288 B2 1/2008 Livingston et al.
7,358,921 B2 4/2008 Snyder et al.
7,411,472 B1 8/2008 West et al.
7,414,590 B2 8/2008 Bij De Vaate et al.
7,444,736 B1 11/2008 Warning
7,675,466 B2 3/2010 Gaucher et al.
7,688,265 B2 3/2010 Irion, II et al.
7,948,441 B2 5/2011 Irion, II et al.
8,035,992 B2 10/2011 Kushta et al.
8,325,093 B2 12/2012 Holland et al.
8,659,499 B1 2/2014 Pluymers
8,753,145 B2 6/2014 Lang et al.
8,952,752 B1 2/2015 Huettner
9,077,083 B1 7/2015 Freeman et al.
9,136,572 B2 9/2015 Carr et al.
9,190,727 B1 11/2015 Urcia et al.
9,236,652 B2 1/2016 Kasemodel
9,373,881 B2 6/2016 Thompson, Jr. et al.
9,402,301 B2 7/2016 Paine et al.
9,437,929 B2 9/2016 Isom et al.
9,490,519 B2 11/2016 Lilly et al.
9,537,208 B2 1/2017 Isom
9,660,333 B2 5/2017 Viscarra et al.
9,780,458 B2 10/2017 Viscarra et al.
2002/0024348 A1 2/2002 Jones et al.
2002/0037656 A1 3/2002 Murakami
2002/0139579 A1 10/2002 Kwark
2003/0020654 A1 1/2003 Navarro et al.
2003/0112200 A1 6/2003 Marino
2003/0184476 A1 10/2003 Sikina et al.
2004/0188836 A1 9/2004 Key et al.
2005/0007286 A1 1/2005 Trott et al.
2005/0095896 A1 5/2005 Tutt
2005/0156802 A1 7/2005 Livingston et al.
2005/0269693 A1 12/2005 Green et al.
2006/0097947 A1 5/2006 McCarville et al.
2007/0173080 A1 7/2007 Johnson et al.
2008/0036665 A1 2/2008 Schadler
2008/0102702 A1 5/2008 Sercu et al.
2008/0150832 A1 6/2008 Ingram et al.
2008/0169992 A1 7/2008 Ortiz et al.
2009/0073075 A1 3/2009 Irion, II et al.
2009/0091506 A1 4/2009 Navarro et al.
2009/0121967 A1 5/2009 Cunningham
2009/0197435 A1 8/2009 Jessup et al.
2009/0213562 A1 8/2009 Thevenard et al.
2009/0322620 A1 12/2009 Pedersen et al.
2010/0053026 A1 3/2010 Van Der Poel
2010/0112826 A1 5/2010 Frasco
2010/0164783 A1 7/2010 Choudhury et al.
2010/0186997 A1 7/2010 Vicich
2011/0089531 A1 4/2011 Hillman et al.
2012/0034820 A1 2/2012 Lang et al.
2012/0068906 A1 3/2012 Asher et al.
2012/0098706 A1 4/2012 Lin et al.
2012/0146869 A1 6/2012 Holland et al.
2012/0212386 A1 8/2012 Massie et al.
2012/0212920 A1 8/2012 Schreffler
2012/0287581 A1 11/2012 Sauerbier et al.
2012/0306698 A1 12/2012 Warnick et al.
2012/0313818 A1 12/2012 Puzella et al.
2013/0003330 A1 1/2013 Chen
2013/0026586 A1 1/2013 Seok et al.
2013/0050055 A1 2/2013 Paradiso et al.
2013/0175078 A1 7/2013 Pai
2013/0187830 A1 7/2013 Warnick et al.
2013/0194754 A1 8/2013 Jung et al.
2013/0207274 A1 8/2013 Liu et al.
2013/0314292 A1 11/2013 Maley
2013/0335931 A1 12/2013 Snider et al.
2014/0004745 A1 1/2014 Komoto et al.
2014/0132473 A1 5/2014 Isom
2014/0152510 A1 6/2014 Manry, Jr. et al.
2014/0264759 A1 9/2014 Koontz et al.
2014/0302807 A1 10/2014 Lee et al.
2015/0015453 A1 1/2015 Puzella et al.
2015/0028961 A1 1/2015 Carr et al.
2015/0123864 A1 5/2015 Boryssenko
2015/0200460 A1 7/2015 Isom et al.
2016/0352023 A1 12/2016 Dang et al.
2017/0104277 A1 4/2017 Viscarra et al.
2018/0040955 A1 2/2018 Vouvakis et al.
2018/0090851 A1 3/2018 Feldman et al.
2018/0175476 A1 6/2018 Teshiba et al.
2018/0337461 A1 11/2018 Kildal et al.

FOREIGN PATENT DOCUMENTS

EP 1 970 952 A2 9/2008
EP 2154747 A1 2/2010
EP 2704259 A2 3/2014
FR 2575336 A1 6/1986
GB 2508679 A 6/2014
JP U-1992027609 3/1992
JP H07-106841 4/1995
JP H11121896 A 1/1999
JP H11145648 A 5/1999
JP 2000-312112 A 11/2000

(56) References Cited

FOREIGN PATENT DOCUMENTS

| | | | |
|---|---|---|---|
| JP | 2006-504375 | A | 2/2006 |
| JP | 2013/060037 | A | 4/2013 |
| TW | 2014-03765 | A | 1/2014 |
| TW | 2014-34203 | A | 9/2014 |
| TW | 2016-05017 | A | 2/2016 |
| WO | WO 2009/077791 | A1 | 6/2009 |
| WO | WO 2014/168669 | A1 | 10/2014 |
| WO | WO 2015/006293 | A1 | 1/2015 |
| WO | WO 2016/138267 | A1 | 9/2016 |

OTHER PUBLICATIONS

Response to U.S. Non-Final Office Action dated Apr. 5, 2018 for U.S. Appl. No. 15/379,775, filed Aug. 1, 2018; 17 Pages.
PCT International Preliminary Report dated Apr. 26, 2018 for International Application No. PCT/US2016/034045; 8 Pages.
PCT International Search Report and Written Opinion dated Apr. 26, 2018 for International Application No. PCT/US2018/015421; 15 Pages.
PCT International Search Report and Written Opinion dated Jan. 3, 2018 for International Application No. PCT/US2017/055059; 17 Pages.
PCT International Search Report and Written Opinion dated Jan. 3, 2018 for International Application No. PCT/US2017/055222; 16 Pages.
U.S. Non-Final Office Action dated Apr. 5, 2018 for U.S. Appl. No. 15/379,761; 20 Pages.
U.S. Non-Final Office Action dated Apr. 5, 2018 for U.S. Appl. No. 15/379,775; 16 Pages.
Hotte et al., "Directive and High-Efficiency Slotted Waveguide Antenna Array for V-Band Made by Wire Electrical Discharge Machining;" Electronics Letters, vol. 51, No. 5; Mar. 5, 2015; pp. 380-382; 2 Pages.
Luo et al., "Meander Line Coupled Cavity-Backed Slot Antenna for Broadband Circular Polarization;" IEEE Antennas and Wireless Propagation Letters, vol. 14; Feb. 2, 2015; pp. 1215-1218; 4 Pages.
Mishra et al., "Array of SIW Resonant Slot Antenna for V Band Applications;" 2013 International Conference on Microwave and Photonics (ICMAP); Dec. 13, 2013; 4 Pages.
Tong et al., "Novel Sequential Rotation Technique for Proadband Circularly Polarized Microstrip Ring Antennas;" 2008 Loughborough Antennas and Propagation Conference; Mar. 17, 2008; 4 Pages.
Wu et al., "A Wideband High-Gain High-Efficiency Hybrid Integrated Plate Array Antenna for V-Band Inter-Satellite Links;" IEEE Transactions on Antennas and Propagation, vol. 63, No. 4; Apr. 2015; pp. 1225-1233; 9 Pages.
Search Report & Written Opinion of the ISA dated Aug. 30, 2016 for International Application No. PCT/US2016/034045; 11 Pages.
U.S. Non-Final Office Action dated May 18, 2017 for U.S. Appl. No. 14/881,582; 21 Pages.
Response to U.S. Non-Final Office Action dated May 18, 2017 for U.S. Appl. No. 14/881,582, filed Jun. 5, 2017; 7 Pages.
Notice of Allowance dated Jun. 23, 2017 for U.S. Appl. No. 14/881,582; 8 Pages.
U.S. Appl. No. 15/379,761, filed Dec. 15, 2016, Isom.
U.S. Appl. No. 15/379,775, filed Dec. 15, 2016, Isom, et al.
U.S. Final Office Action dated Sep. 14, 2018 for U.S. Appl. No. 15/379,761; 20 Pages.
U.S. Final Office Action dated Sep. 21, 2018 for U.S. Appl. No. 15/379,775; 19 Pages.
Taiwan Examination Report (with English Translation) dated Oct. 31, 2018 for Taiwan Application No. 106135617; 23 Pages.
Taiwan Examination Report (with English Translation) dated Nov. 2, 2018 for Taiwan Application No. 106135613; 20 Pages.
Response to U.S. Final Office Action dated Sep. 14, 2018 for U.S. Appl. No. 15/379,761; Response filed Dec. 14, 2018; 11 Pages.
Response to U.S. Final Office Action dated Sep. 21, 2018 for U.S. Appl. No. 15/379,775; Response filed Dec. 21, 2018; 13 Pages.
Cavallo et al.; "Analysis of Common-Mode Resonances in Arrays of Connected Dipoles and Possible Solutions"; Radar Conference; IEEE; Sep. 30, 2009; 4 Pages.
Chang-Chien et al., "MMIC Compatible Wafer-Level Packaging Technology;" Proceedings of the International Conference on Indium Phosphide and Related Materials (19$^{th}$IPRM); May 14-18, 2007; 4 Pages.
Chang-Chien et al., "MMIC Packaging and Heterogeneous Integration Using Wafer-Scale Assembly;" Proceedings of the CS MANTECH Conference; May 14-17, 2007; 4 Pages.
Chang-Chien, "Wafer-Level Packaging and Wafer-Scale Assembly Technologies;" Presentation by Northrop Grumman Aerospace Systems (NGAS); Proceedings of the CS MANTECH Workshop 6; May. 17, 2010; 43 Pages.
European 161/162 Communication dated Jul. 9, 2015 corresponding to European Application No. 13721516.6; 2 Pages.
Green, "DARPA's Heterogeneous Integration Vision and Progress on Modular Design;" Presentation by DARPA; Proceedings of the 3D Architectures for Semiconductor Integration and Packaging Conference (ASIP); Dec. 17, 2015; 17 Pages.
Gu et al., "W-Band Scalable Phased Arrays for Imaging and Communications;" Integrated Circuits for Communications, IEEE Communications Magazine; Apr. 2015; 9 Pages.
Hees et al.; "Ultra Broadband Dual Polarized Dipole Array with Metallic Reflector"; International Conference on Ultra Wideband; IEEE; Sep. 9, 2009; pp. 744-747; 4 Pages.
Japanese Office Action (with English Translation) dated Jun. 21, 2016 corresponding to Japanese Application No. 2015-541757; 8 Pages.
Japanese Office Action dated Feb. 28, 2017 for Japanese Pat. App. No. 2015-541757 with English Translations; 4 Pages.
Kasemodel et al.; "Broadband Planar Wide-Scan Array Employing Tightly Coupled Elements and Integrated Balun"; Phased Array Systems and Technology (ARRAY) 2010 IEEE International Symposium; Oct. 12, 2010; pp. 467-472; 6 Pages.
Kindt et al.; "Polarization Correction in Dual-Polarized Phased Arrays of Flared Notches"; Antennas and Propagation (APSURSI); IEEE International Symposium; Jul. 3, 2011; pp. 1961-1964; 4 Pages.
Korean Office Action (with English Translation) dated Feb. 27, 2016 corresponding to Korean Application No. 10-2015-7010618; 4 Pages.
Mishra et al., "Array of SIW Resonant Slot Antenna for V Band Applications;" Proceedings of the International Conference on Microwave and Photoics (ICMAP); Dec. 13-15, 2013; 4 Pages.
Nesic et al.; "Wideband Printed Antenna with Circular Polarization"; Antennas and Propagation Society International Symposium; Jul. 13, 1997; pp. 1882-1885; 4 Pages.
Notice of Allowance dated Sep. 16, 2016 corresponding to U.S. Appl. No. 13/674,547; 17 Pages.
PCT International Preliminary Report dated May 21, 2015 corresponding to International Application No. PCT/US2013/038408; 9 Pages.
PCT International Preliminary Report of the ISA for Application No. PCT/US2014/012929 dated Oct. 22, 2015; 8 Pages.
PCT International Search Report and Written Opinion dated Aug. 30, 2016 corresponding to International Application No. PCT/US2016/034045; 11 Pages.
PCT International Search Report and Written Opinion dated Dec. 8, 2017 for International Application No. PCT/US2017/054836; 15 Pages.
PCT International Search Report and Written Opinion dated Jun. 28, 2013 corresponding to International Application No. PCT/US2013/038408; 14 Pages.
PCT International Search Report and Written Opinion of the ISA for PCT/US2014/012929 dated Apr. 28, 2014; 13 Pages.
Popovic, "Micro-coaxial Micro-fabricated Feeds for Phased Array Antennas;" Proceedings of the 2010 IEEE International Symposium on Phased Array Systems and Technology (ARRAY); Oct. 12-15, 2010; 10 Pages.
Response (with Amended Claims) to European 161/162 Communication dated Jul. 9, 2015 corresponding to European Application No. 13721516.6; Response filed Jan. 19, 2016; 34 Pages.

(56) References Cited

OTHER PUBLICATIONS

Response (with English Translation and Specification) to Taiwan Examination Report dated Nov. 2, 2018 for Taiwan Application No. 106135613; Response filed Jan. 8, 2019; 9 Pages.
Response (with English Translation of Response, Current Claims and Amended Specification) to Taiwan Office Action dated Jun. 19, 2018 for Taiwan Application No. 106135418; Response filed Sep. 12, 2018; 40 Pages.
Response (with English Translation, Claims and Specification) to Taiwan Examination Report dated Oct. 31, 2018 for Taiwan Application No. 106135617; Response filed Jan. 7, 2019; 22 Pages.
Response (with Foreign Associate Reporting Letter) to Japanese Office Action dated Jun. 21, 2016 corresponding to Japanese Application No. 2015-541757; Response filed Sep. 21, 2016; 7 Pages.
Response (with Foreign Associate Reporting Letter) to Korean Office Action dated Feb. 27, 2016 corresponding to Korean Application No. 10-2015-7010618; Response filed Apr. 27, 2016; 15 Pages.
Response to U.S. Final Office Action dated Dec. 3, 2015 corresponding to U.S. Appl. No. 13/674,547; Response filed Feb. 22, 2016; 16 Pages.
Response to U.S. Final Office Action dated Jan. 2, 2019 for U.S. Appl. No. 15/381,286; Response and RCE filed Feb. 5, 2019; 10 Pages.
Response to U.S. Final Office Action dated Jul. 1, 2016 corresponding to U.S. Appl. No. 13/674,547; Response filed Aug. 18, 2016; 14 Pages.
Response to U.S. Final Office Action dated Sep. 21, 2018 for U.S. Appl. No. 15/379,775; Response and RCE filed Dec. 21, 2018; 16 Pages.
Response to U.S. Non-Final Office Action dated Jul. 5, 2018 for U.S. Appl. No. 15/381,286; Response filed Sep. 6, 2018; 8 Pages.
Response to U.S. Office Action dated Apr. 7, 2016 corresponding to U.S. Appl. No. 13/674,547; Response filed Jun. 21, 2016; 16 Pages
Response to U.S. Office Action dated Jun. 8, 2015 corresponding to U.S. Appl. No. 13/674,547; Response filed Aug. 28, 2015; 18 Pages.
Shin et al., "A 108-114 GHz 4x4 Wafer-Scale Phased Array Transmitter with High-Efficiency On-Chip Antennas;" IEEE Journal of Solid-State Circuits, vol. 48, No. 9; Sep. 2013; 15 Pages.
Taiwan Examination Report (with English Translation) dated Nov. 26, 2018 for Taiwan Application No. 106135418; 8 Pages.
Taiwan Office Action (with Search Report) dated Jun. 19, 2018 for Taiwan Application No. 106135418; 18 Pages.
Taiwan Statement of Reasons for Re-Examination (with Reporting Letter dated Jan. 8, 2019 and English Translation) dated Jan. 8, 2019 for Taiwan Application No. 106135418; 7 Pages.
U.S. Appl. No. 13/859,072 Amendment filed Nov. 24, 2015; 12 Pages.
U.S. Appl. No. 13/859,072 Office Action dated Aug. 25, 2015; 16 Pages.
U.S. Final Office Action dated Dec. 3, 2015 corresponding to U.S. Appl. No. 13/674,547; 22 Pages.
U.S. Final Office Action dated Jan. 2, 2019 for U.S. Appl. No. 15/381,286; 16 Pages.
U.S. Final Office Action dated Jul. 1, 2016 corresponding to U.S. Appl. No. 13/674,547; 30 Pages.
U.S. Non-Final Office Action dated Jan. 11, 2019 for U.S. Appl. No. 15/379,761; 20 Pages.
U.S. Non-Final Office Action dated Jan. 14, 2019 for U.S. Appl. No. 15/379,775; 22 Pages.
U.S. Non-Final Office Action dated Jul. 5, 2018 for U.S. Appl. No. 15/381,286; 8 Pages.
U.S. Office Action dated Apr. 7, 2016 corresponding to U.S. Appl. No. 13/674,547; 27 Pages.
U.S. Office Action dated Jun. 8, 2015 corresponding to U.S. Appl. No. 13/674,547; 23 Pages.
Urteaga, "3D Heterogeneous Integration of III-V Devices and Si CMOS;" Presentation by Teledyne Scientific Company; Proceedings of the 3D Architectures for Semiconductor Integration and Packaging Conference (ASIP); Dec. 17, 2015; 26 Pages.
Wong et al., "Broad-Band Single-Patch Circularly Polarized Microstrip Antenna with Dual Capacitively Coupled Feeds;" Proceedings of the IEEE Transactions on Antennas and Propagation, vol. 49, No. 1; Jan. 2001; 4 Pages.
Wong et al., "Design of Dual-Polarized L-Probe Patch Antenna Arrays With High Isolation;" Proceedings of the IEEE Transactions on Antennas and Propagation, vol. 52, No. 1; Jan. 2004; 8 Pages.
Zihir et al., "A 60 GHz 64-element Wafer-Scale Phased-Array with Full-Reticle Design;" Proceedings of the 2015 IEEE MTT-S International Microwave Symposium; May 17-22, 2015; 3 Pages.

* cited by examiner

TRIPOLE CURRENT LOOP RADIATING ELEMENT WITH INTEGRATED CIRCULARLY POLARIZED FEED

BACKGROUND

As is known in the art, a plurality of antenna elements can be disposed to form an array antenna. It is often desirable to utilize antenna elements capable of receiving orthogonally polarized radio frequency (RF) signals. Such antenna elements include, for example, four arm, dual polarized current sheet antenna elements such as tightly coupled dipole array (TCDA), planar ultrawideband modular antenna (PUMA), and other known current loop radiators. These radiator elements rely on polarization aligned coupling to maintain their polarization scan performance over the scan volume, particularly at large scan angles. Patch radiators may also be used and are low cost and easy to integrate, but suffer from poor circularly polarized performance over scan. Deposing such antenna elements on a rectangular array lattice pattern (or more simply a "rectangular lattice") provides certain advantages since a rectangular lattice is naturally suited to aligning the orthogonally polarized arms of the respective radiating element and can maintain radiator performance over scan, particularly at far scan angles.

SUMMARY

In accordance with the concepts, systems, methods and techniques described herein, a tripole current loop antenna element is provided having three conductors (also sometimes referred to herein as "arms"), with each of the three conductors including a ground via to couple a surface of the respective conductor to a ground plane and a signal via to receive radio frequency (RF) signals provided from a single feed circuit. The feed circuit is disposed to provide the RF signals to each of the three conductors having equal amplitudes and distributed with relative phases of 0°/120°/240° respectively (i.e., the RF signal provided to each arm is phase shifted by 120° from an adjacent one of the arms).

With this particular arrangement, RF signals having a circular polarization may be coupled to and/or from the antenna element via the single feed circuit. In an embodiment, the three conductors can be spaced from each other and disposed such that they provide polarization alignment when they are disposed within an array antenna having a triangular lattice spacing.

In an embodiment, the antenna element having three conductors and disposed in an array antenna on the triangular lattice results in the ability to provide an array antenna having more radiating elements per area without resulting in grating lobes as compared with antenna elements disposed on rectangular lattices. Thus, the number of active device channels required to realize a desired level of gain for a particular antenna element or array of antenna elements may be reduced. In some embodiments, the single feed used to realize the right-hand circular polarized (RHCP) antenna element can reduce the number of active devices needed by half compared to a dual feed architecture. Thus, an antenna element having three conductors (or arms) may be used to provide a low profile, circularly polarized, antenna element suitable for use in an array antenna having a triangular lattice shape and configured to generate circular polarization using a single feed and able to maintain circularly polarized performance over a broad scan volume. In an embodiment, a broad scan volume may refer to scan volumes that cover all scan angles out to a 60° scan angle (i.e., 60° scan cone) or greater with respect to a boresight axis of the respective antenna element or array antenna. For example, in some embodiments, such as the embodiments described herein, a circular polarized performance can be maintained up to a 70° scan volume.

For example, the antenna element can be sized such that it is compact and thus may be easier to accommodate within a unit cell of an array antenna with enough room to also accommodate vertical transitions to active devices. In an embodiment, the structure of the antenna element includes ground vias to form a grounded structure where the entire radiator circuit is DC grounded. Thus, improving high frequency performance and inhibiting propagation of surface waves. In an embodiment, high frequency may refer to a frequency in the range of about 2 GHz to about 50 GHZ (e.g., from the S-band range to the Q-band range). In some embodiments, high frequency may refer to frequencies above the Q-band frequency range. It should be appreciated that the antenna elements as described herein can be scaled to a variety of different frequencies with such frequencies selected based upon the needs of a particular application in which the antenna or antenna element is being used as well as upon manufacturing technologies (e.g., printed wiring board (PWB) technology).

The feed circuit can include a signal port, antenna ports, a feed line and multiple delay lines to provide to each of the three conductors, which connect to the antenna element, RF signals having approximately equal amplitudes and a phase relationship (e.g., ideally distributed at 0°/120°/240° respectively) such that the signal provided to each arm of an antenna element is phase shifted by approximately 120° from an adjacent arm. For example, in some embodiments, the feed circuit design produces a phase shift of approximately 120° between RF signals provided to adjacent ones of antenna element conductors by means adapted from Marchand balun design, but that produces the necessary approximate 120° phase difference (instead of approximately 180° used in a conventional Marchand balun) by creating an asymmetry in the length of the two short circuited stubs that realize the RF chokes in the feed circuit. The feed circuit properties, such as but not limited to, the length, width (i.e., impedance) and/or shape of the feed and delay lines can be selected to provide the appropriate phase shift and amplitude distribution between RF signals provided to adjacent conductors. Thus, the feed circuit as described herein can provide approximately equal RF signals to three conductors by exciting signal vias coupled to each of the conductors with RF signals 120° out of phase relative to an adjacent one of the three conductors. This feed circuit is also compact enough to fit within the radiator unit cell lattice, which is not possible with a feed circuit provided from a traditional three-way reactive divider with delay lines.

In a first aspect a radio frequency (RF) antenna element includes a substrate having first and second opposing surfaces, three conductors disposed on the first surface of said substrate, said three conductors being physically spaced apart from each other and being arranged so as to form an antenna element responsive to RF signals at a desired frequency range and a feed circuit having a signal port, and first, second and third antenna ports. Each of the first, second and third antenna ports coupled to a respective one of the three conductors, said feed circuit configured such that in response to an RF signal provided to the signal port thereof, said feed circuit provides at each of the first, second and third antenna ports, RF signals having approximately equal amplitudes and phases shifted by approximately 120 degrees. Ideally, the RF signals have equal amplitudes and phase shifts of 120 degrees. In practical systems, such ideal values may not be achievable over a particular frequency band due to manufacturing tolerances.

In embodiments, three conductors may be provided having similar geometric shape. The antenna element may include a first signal via coupling the first antenna port to a first conductor of the three conductors, a second signal via coupling the second antenna port to a second conductor of the three conductors and a third signal via coupling the third antenna port to a third conductor of the three conductors.

A first ground via can be formed extending from the first conductor to a first ground plane, a second ground via can be formed extending from the second conductor to the first ground plane and a third ground via can be formed extending from the third conductor to the first ground plane.

A plurality of leakage vias can be disposed having a geometric relationship with respect to each other. Each of the plurality of leakage vias can couple the first ground plane to a second ground plane.

In embodiments, the antenna element comprises two layers such that the three conductors are disposed in a first layer and the plurality of leakage vias are disposed in a second layer.

The feed circuit further may include a feed line (e.g., signal path) coupling the signal port to the second signal via, wherein the feed line provides the RF signals to each of the first, second and third signal vias having equal amplitudes and having an approximately 120 degree phase shift relative to the RF signals provided to an adjacent one of the first, second and third signal vias. The feed circuit may include a first delay line having a first length, a second delay line having a second length and a third delay line having a third length. In an embodiment, the first delay line may couple the first ground via to the first signal via, the second delay line may couple the second ground via to the second signal via and the third delay line may couple the second signal via to the third signal via.

A portion of the feed line can be disposed proximate to a portion of the first delay line to couple the feed line to the first delay line such that the first delay serves as a ground reference to the feed line. The first delay line and second delay line can be spaced a predetermined distance from each other. The predetermined distance can be selected such that it produces the approximately 120 degree phase shift between the RF signals provided to the first and second signal vias.

In embodiments, the predetermined distance can be selected such that a combined power factor of the RF signals provided to the second signal via and third via is two times greater than a power factor of the RF signals provided to the first signal via.

A length of the third delay line can be selected to produce the approximately 120 degree phase shift between the RF signals provided to the second signal via and third signal via.

In another aspect, an array antenna includes a substrate having first and second opposing surfaces and a plurality of antenna elements disposed on the first surface of said substrate.

Each of the plurality of antenna elements includes three conductors physically spaced apart from each other and arranged so as to be responsive to RF signals at a desired frequency range, and a feed circuit having a signal port, and first, second and third antenna ports. Each of the first, second and third antenna ports coupled to a respective one of the three conductors, said feed circuit configured such that in response to an RF signal provided to the signal port thereof, said feed circuit provides at each of the first, second and third antenna ports, RF signals having equal amplitudes and phases shifted by approximately 120 degrees.

Each of the antenna elements may include a first signal via coupling the first antenna port to a first conductor of the three conductors, a second signal via coupling the second antenna port to a second conductor of the three conductors and a third signal via coupling the third antenna port to a third conductor of the three conductors. In some embodiments, each of the antenna elements include a first ground via extending from the first conductor to a first ground plane, a second ground via extending from the second conductor to the first ground plane and a third ground via extending from the third conductor to the first ground plane.

Each of the antenna elements may include a plurality of leakage vias disposed having a geometric relationship with respect to each other, each of the plurality of leakage vias coupling the first ground plane to a second ground plane. In embodiments, each of the antenna elements includes two layers such that the three conductors are disposed in a first layer and the plurality of leakage vias are disposed in a second layer.

A feed line coupling the signal port to the second signal via may be included in each of the antenna elements. The feed line can provide the RF signals to each of the first, second and third signal vias having approximately equal amplitudes and having an approximately 120 degree phase shift relative to the RF signals provided to an adjacent one of the first, second and third signal vias.

In embodiments, each of the antenna elements includes a first delay line having a first length, a second delay line having a second length, and a third delay line having a third length. The first delay line may couple the first ground via to the first signal via, the second delay line may couple the second ground via to the second signal via, and the third delay line may couple the second signal via to the third signal via.

A portion of the feed line can be disposed proximate to a portion of the first delay line to couple the feed line to the first delay line such that the first delay serves as a ground reference to the feed line.

The first delay line and the second delay line can be spaced a predetermined distance from each other. The predetermined distance can be selected such that it produces the approximately 120 degree phase shift between the RF signals provided to the first and second signal vias. A length of the third delay line can be selected to produce the approximately 120 degree phase shift between the RF signals provided to the second signal via and third signal via.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

The foregoing features may be more fully understood from the following description of the drawings in which.

Like reference symbols in the various drawings indicate like elements.

DETAILED DESCRIPTION

Figure 1:
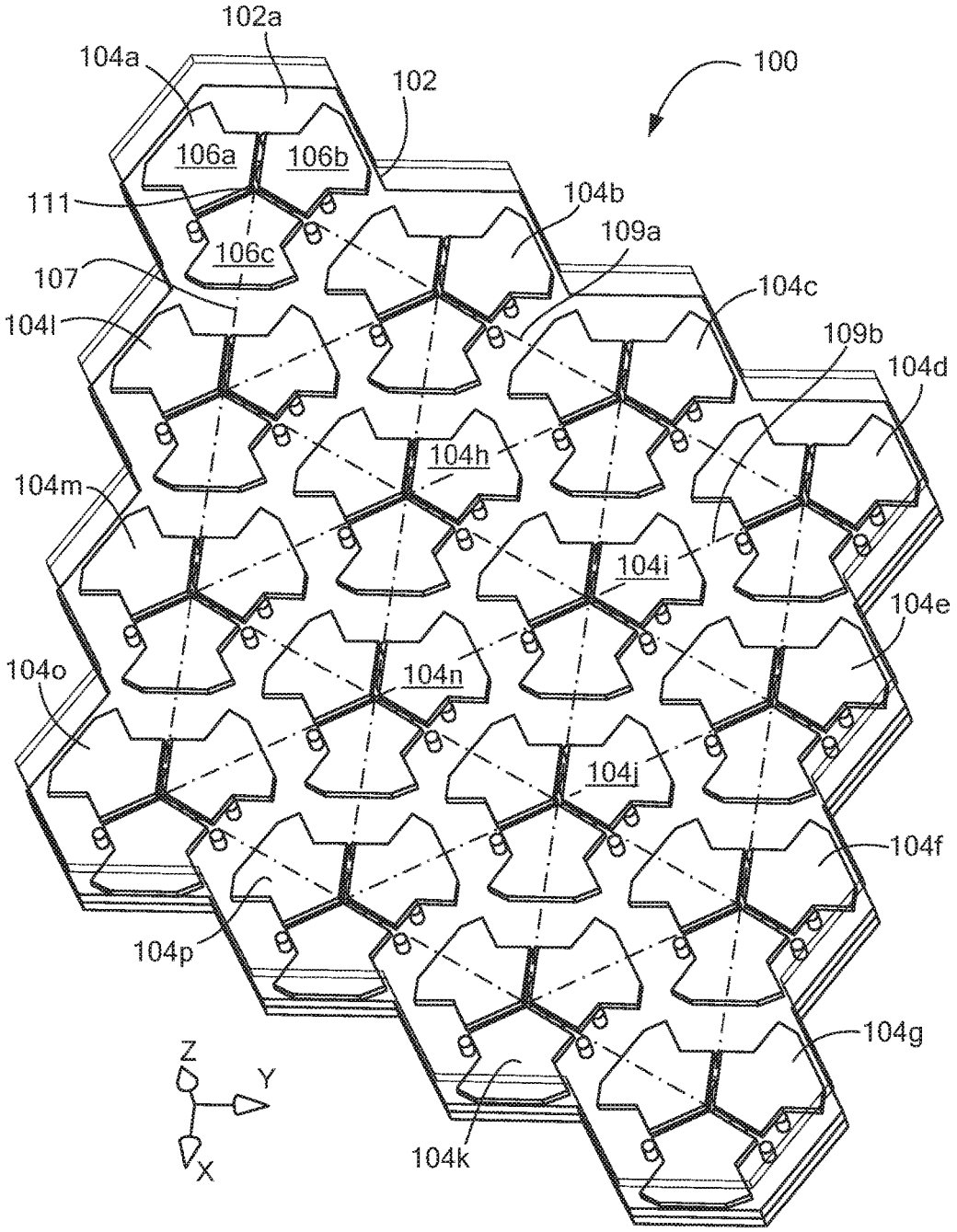
FIG. 1 shows a portion of an array antenna provided from a plurality of tripole antenna elements disposed on a triangular lattice.

Now referring to FIG. 1, an array antenna (or more simply "array") 100 includes a plurality of so called "tripole current loop" antenna elements 104*a*-104*p*. Each of the antenna elements 104*a*-104*p* are provided from three conductors 106*a*-106*c* (also referred to herein as "arms") disposed in a predefined spaced relation on a first surface 102*a* of a substrate 102. In particular, conductors 106*a*-106*c* are disposed having a triangular relationship with respect to a center point. That is. each conductor or arm in an element is spaced apart and is rotated by an angle of about 120° with respect to the other conductors which comprise the element.

As illustrated in FIG. 1, array 100 is provided having a triangular lattice. That is, antenna elements 104*a*-104*p* can be disposed on substrate 102 having a triangular lattice spacing (for clarity, a triangular grid 107 is superimposed over the example array illustrated in FIG. 1; it should be appreciated that grid 107 is not part of the array 100, but rather is only included for clarity). As illustrated in FIG. 1, each of antenna elements 104*a*-104*p* are disposed at one of a plurality of vertices 111 (or nodes) of triangular grid 107. Thus, antenna elements 104*a*-104*p* are disposed at various points along a triangular grid 107.

In the illustrative embodiment of FIG. 1, arms of antenna elements 104*a*, 104*b*, 104*c*, 104*d* are aligned at least along line 109*a* and arms of antenna elements 104*d*, 104*i*, 104*h*, 104*o* are aligned at least along line 109*b*. Further, and as noted above, conductors 106*a*-106*c* which make up each of antenna elements 104*a*-104*p*, are disposed having a triangular relationship (i.e., 120° relationship) with respect to each other, and in the illustrative embodiment of FIG. 1, a center point between the three conductors is aligned with at least one of the plurality of vertices 111 (or node) of triangular grid 107.

Conductors 106*a*-106*c* may be provided from any electrical conductor (e.g., a metallic material) or any material electrically responsive to RF signals provided thereto. Conductors 106*a*-106*c* may be formed having the same or substantially same geometric shape. In other embodiments, one or more of conductors 106*a*-106*c* may have different geometric shapes. Conductors 106*a*-106*c* may be formed in a variety of different shapes, including but not limited to any regular or irregular geometric shape. In some embodiments, the thickness (or width) of conductors 106*a*-106*c* can be varied to modify (e.g., improve) design performance. The shape and/or properties of conductors 106*a*-106*c* can be selected based, at least in part, on the dimensions of array antenna 100 and/or a particular application of array antenna 100. For example, the shape of conductors 106*a*-106*c* can be modified to change a performance characteristic and/or frequency band within which the respective antenna element 104 or array antenna 100 operates. Such performance characteristics include, but are not limited to, return and insertion loss, gain, and/or axial ratio characteristics the respective antenna element 104 or array antenna 100.

Substrate 102 comprises a dielectric material. In some embodiments, substrate 102 may include multiple layers some of which may be a dielectric material and some of which may be a non-dielectric material, as will be discussed in greater detail below with respect to FIGS. 2 and 4-5.

Figure 2:
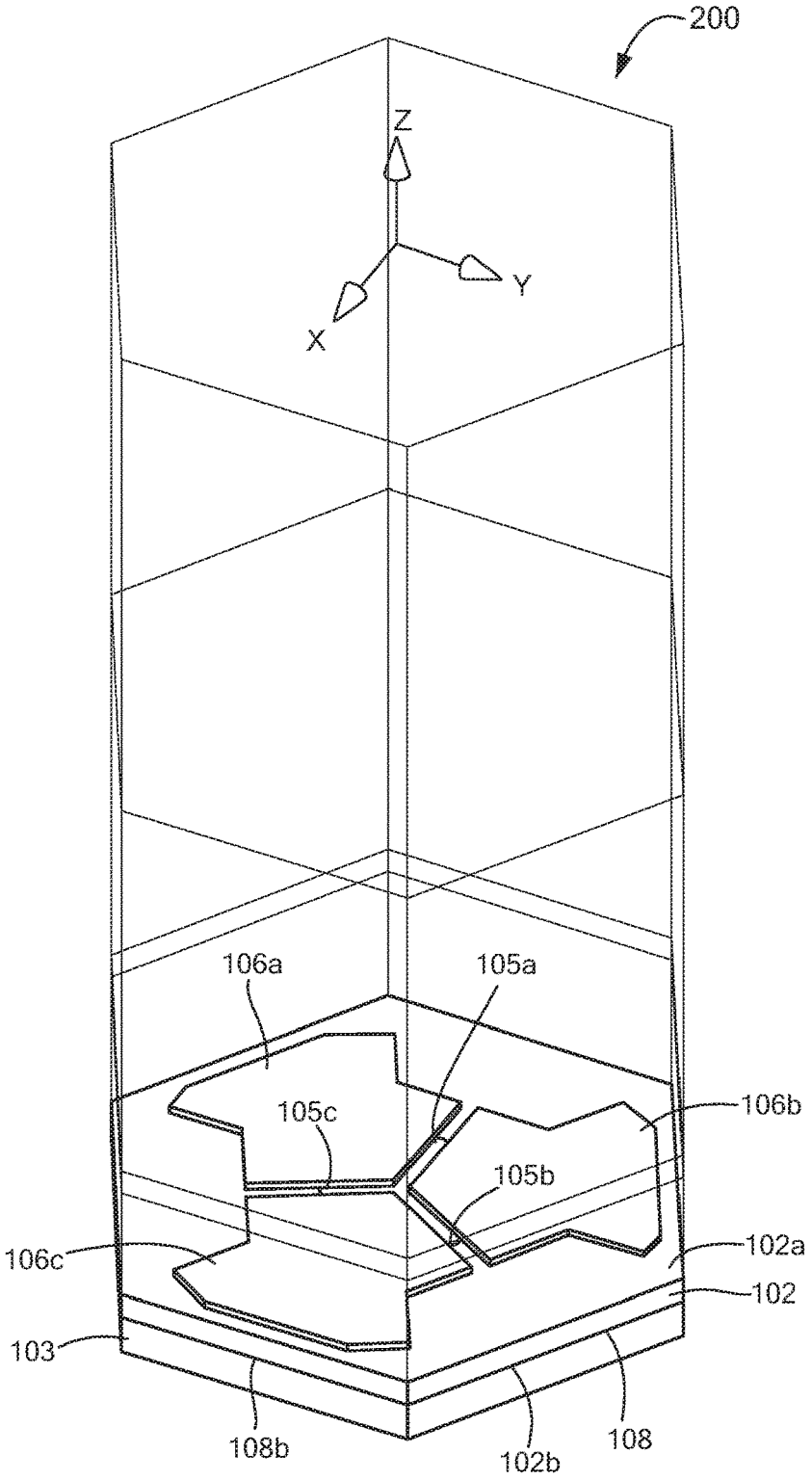
FIG. 2 shows a single antenna element unit cell of the array of FIG. 1.

Referring now to FIG. 2, an array antenna unit cell 200 (hereinafter unit cell) includes three conductors 106*a*-106*c* disposed on a first surface 102*a* of a substrate 102 so as to form antenna element 104 on first surface 102*a* of substrate 102. It should be appreciated that antenna element 104 may be the same as or substantially similar to at least one of the plurality of antenna elements 104*a*-104*p* of FIG. 1. In the illustrative embodiment of FIG. 2, unit cell 200 is provided having six (6) sides. Unit cells having other shapes, may of course, also be used.

Unit cell 200 further includes a ground plan 108 disposed on a second, opposite surface 102*b* of substrate 102. A second substrate 103 may be disposed over a second surface 108*b* of ground plane 108. Each of conductors 106*a*-106*c* may be coupled to ground 108 through a ground via as will be described in more detailed below with respect to FIG. 3.

Thus, array antenna 100 of FIG. 1 may include a plurality of unit cells, each having antenna elements comprising three conductors 106*a*-106*c* positioned such that they are disposed adjacent to each other and physically spaced apart in a center of the respective unit cell.

Conductors 106*a*-106*c* are disposed on first surface 102*a* of substrate 102 and spaced apart from each other. Thus, a gap 105*a*-105*c* exists between each of conductors 106*a*-106*c* such that the conductors 106*a*-106*c* are not in physical contact.

Conductors 106*a*-106*c* can, for example, be spaced apart from each other and arranged along first surface 102*a* so as to be responsive to radio frequency (RF) signals at a desired frequency range. In some embodiments, the spacing between conductors 106*a*-106*c* can be selected based at least in part on performance requirements and/or frequency band requirements of a particular application in which a respective antenna element 104 and/or array antenna 100 is used. For example, changing the spacing (e.g., changing the gap) between conductors 106*a*-106*c* can change the return loss and insertion loss performance, gain, and/or axial ratio characteristics of a respective antenna element 104 and/or array antenna 100. In some embodiments, antenna element 104 and conductors 106*a*-106*c* can be configured to be responsive to RF signals in the Q band frequency range (e.g., 33-50 GHZ). However, it should be appreciated that antenna element 104 and conductors 106*a*-106*c* can be configured to be responsive to RF signals in a variety of different frequency ranges, based at least in part upon the needs of a particular application in which antenna element 104 is used.

As illustrated in FIG. 2, conductors 106*a*-106*c* are disposed having a triangular relationship (i.e., 120° relationship) with respect to each other. Such an arrangement allows a center point between the three conductors to be aligned at one of the plurality of vertices (or nodes) 111 (FIG. 1) of a triangular grid (e.g., triangular grid 107 of FIG. 1) so as to provide an array having a triangular lattice structure. In an embodiment, the use of three conductors 106*a*-106*c* having a spaced triangular relationship provides for polarization alignment between conductors 106*a*-106*c* and a triangular lattice of an array antenna which may be formed by antenna elements provided from conductors 106*a*-106*c* and substrate 102. The polarization alignment of conductors 106*a*-106*c* can provide for a more predictable change over scan in mutual coupling between antenna elements in an array antenna, such as between antenna elements 104 of array antenna 100 of FIG. 1. The more predictable change over scan can provide an improved scan performance, particularly at far scan angles.

The use of three conductors 106*a*-106*c* (instead of four as in traditional quad pole designs) reduces the footprint required by conductors 106*a*-106 within unit cell 100 and facilitates inclusion of additional circuitry within unit cell 200. Additionally, the use of the triangular lattice instead of a rectangular lattice provides a large unit cell area that is substantially grating lobe free, which also provides more space for feed circuitry and vertical vias. This additional area for circuitry can become very important at higher frequencies where a particular application of an antenna element or array antenna is required by grating lobe physics to be on a smaller lattice to maintain scan performance. For example, conductors 106*a*-106*c* can be sized and provided within unit cell 200 with enough spacing to accommodate vertical transitions to active devices (not shown). The shape and triangular relationship between the three spaced conductors or arms 106*a*-106*c* which form the antenna element allows the antenna element to be used in an array having a triangular lattice. This, in turn, allows for fewer antenna elements 104*a*-104*p* to be used within an array antenna of a given size (area) as compared to a similarly sized array having a rectangular lattice structure. Such a decrease in the number of antenna elements maintains antenna gain while reducing overall array cost (because fewer active devices and components are required to support fewer channels, simplifying packaging of components on the array and reducing component cost).

Figure 3:
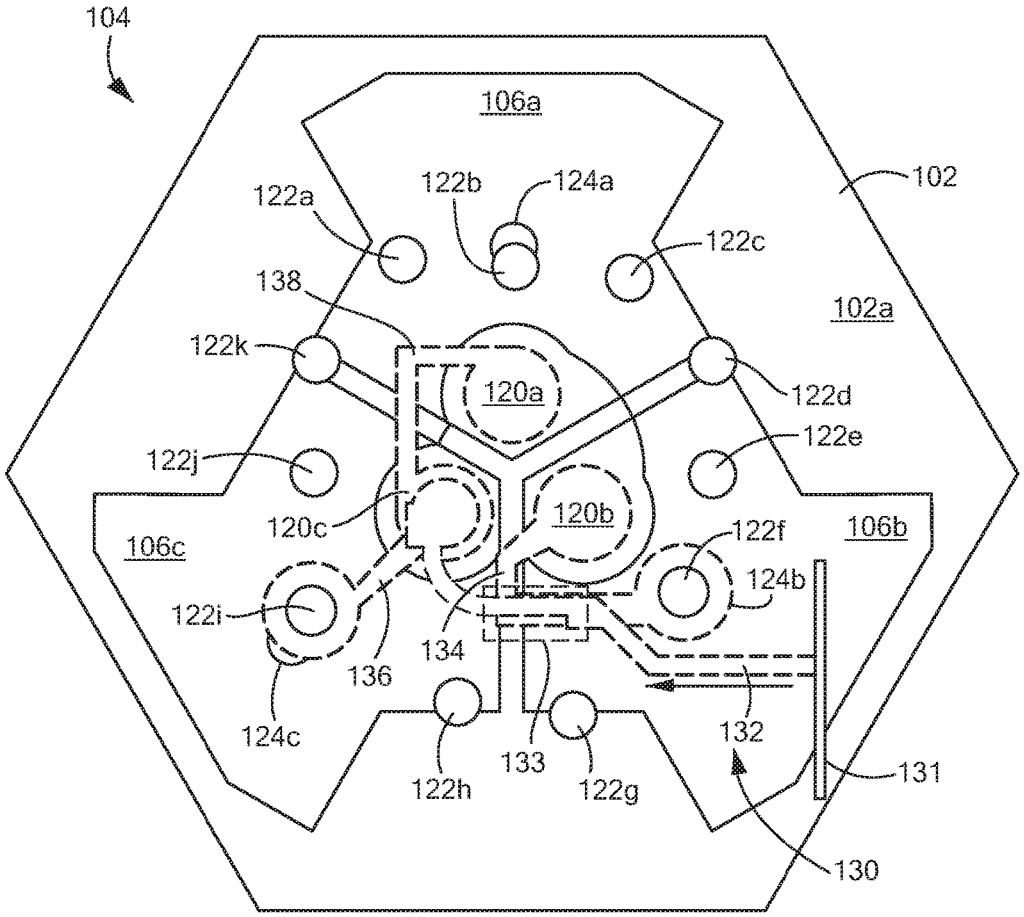
FIG. 3 shows a bottom view of an antenna element of FIG. 1.
Figure 4:
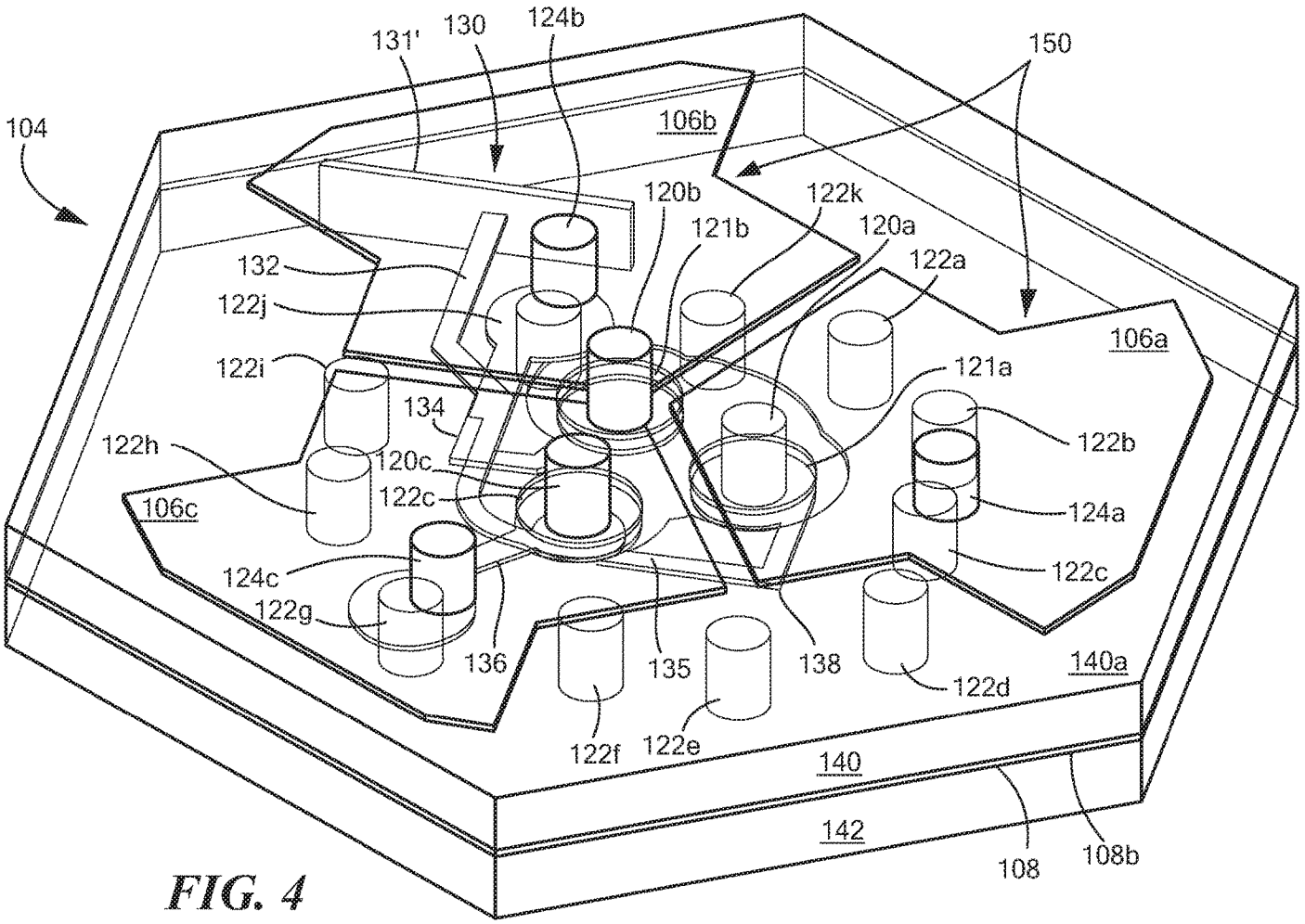
FIG. 4 is a transparent isometric view of the antenna element of FIG. 3.

Referring now to FIGS. 3 and 4 in which like elements are provided having like reference designations, each of conductors 106*a*-106*c* include at least one signal via 120*a*-120*c* and at least one ground via 124*a*-124*c* to couple the respective conductors to a feed circuit 130 and a ground plane (e.g., ground plane 108 of FIG. 2) respectively. For example, a first signal via 120*a* and a first ground via 124*a* are coupled to conductor 106*a*. A second signal via 120*b* and a second ground via 124*b* are coupled to conductor 106*b*. A third signal via 120*c* and a third ground via 124*c* are coupled to conductor 106*c*. Thus, a tripole antenna element configured to generate circular polarizations can be provided having a single feed, here feed circuit 130.

Feed circuit 130 includes a signal path 132 coupled to first, second and third antenna ports 121*a*-121*c* through signal paths 134, 136, 138 and signal vias 120*a*-120*c* with paths 134, 136, 138 corresponding to delay lines. Signal path 132 is coupled to port 131 (e.g., signal port interface) where a vertical RF via transition couples feed circuit 130 to various circuit portions of which the respective antenna element is a part. For example, in one embodiment, port 131 couples feed circuit 130 to active devices mounted on a printed wiring board (PWB). In some embodiments, signal path 132 may be referred to herein as a feed line.

A first end of first signal via 120*a* is coupled to first conductor 106*a* and a second end of signal via is coupled to feed circuit 130. In this way, RF signals may be coupled between the antenna element and port 131. Similarly, second signal via 120*b* has a first end coupled to second conductor 106*b* and a second end coupled feed circuit 130 and third signal via 120*c* has a first end coupled to third conductor 106*c* and a second end coupled to feed circuit 130. Thus, feed circuit 130 can provide RF signals to each of first, second and third conductors 106*a*-106*c*.

The feed circuit 130 can be formed and configured to provide RF signals having equal amplitudes and phases shifted by 120° to conductors 106*a*-106*c*. For example, signal path 132 and each of delay lines 134, 136, 138 can be positioned, spaced and/or sized such that feed circuit 130 provides RF signals to first, second and third conductors 106*a*-106*c* respectively that are phase shifted 120° from RF signals provided to an adjacent (or neighboring) one of first, second and third conductors 106*a*-106*c*. Thus, each of the arms may be excited from signals provided through the three signal vias 120*a*-120*c*.

In this illustrative embodiment, feed circuit 130 is provided from a pair of conductor signal layers (i.e. as a two-layer feed) which provides 0, 120 and 240 degree phase shifted equal amplitude signals to antenna element arms 106*a*-106*c*.

Signal path 132 includes a coupling region 133 in which path 134 serves as a ground to signal path 132. Coupling region 133 directs one-third of the power fed from a first end of signal path 132 (i.e. a port 131) to conductor 106*b* and two-thirds of the power propagates along path portion 132*b* toward conductors 106*a*, 106*b*. At signal via 120*c*, the remaining power is split equally such that one-third of the total power provided at input port 131 is provided to conductor (or arm) 106*c* and one-third of the power is provided to conductor (or arm) 106*a* via signal path 138. It should be appreciated that paths 134, 136, 138 may be provided having a width selected such that the signal path acts as an RF choke. Thus, each of the arms 106*a*-106*c* receive signals having an equal amount of signal power with relative phase shifts of 0°/120°/240° for right hand circuit polarization (RHCP).

As illustrated in FIG. 3, a first end of feed line 132 is configured to couple RF signals to and/or from port 131, which, in turn, couples signals to and/or from various portions of an RF system of which antenna element 104 is a part. For example, port 131 may be provided as an interface that couples feed circuit 130 to the various portions of an RF system (e.g., passive or active devices and/or circuits) through a vertical via transition. Thus, feed line 132 couples signals between the respective antenna ports and input/output port 131.

Feed circuit 130 includes a first delay line 134 coupling second signal via 120*b* to a second ground via 124*b*. A second delay line 136 couples third signal via 120*c* to a third ground via 124*c*, and a third delay line 138 couples third signal via 120*c* to first signal via 120*a*.

Feed line 132 couples to third signal via 120*c* with third signal via 120*c* coupled to first signal via 120*a* through third delay line 138. Thus, feed line 132 can be configured to provide RF signals having a greater power factor to third signal via 120*c* as compared to the RF signal provided to second signal via 120*b*, as third signal via 120*c* is coupled to first signal via 120*a* and shares (e.g., splits) the RF signals with first signal via 120*a*. In one embodiment, a combined power factor of RF signals provided to third and first signal vias 120*c*, 120*a* can be two times greater than a power factor of RF signals provided to second signal via 120*b*.

First delay line 134 and second delay line 136 can be spaced apart from each other a predetermined distance such that the predetermined distance produces a 120° phase shift between the RF signals provided to second signal via 120*b* and third signal via 120*c*. It should be appreciated that the predetermined distance between first delay line 134 and second delay line 136 can be selected to achieve a variety of different phase shifts.

Third delay line 136 can be formed such that it splits RF signals between third signal via 120*c* and first signal via 120*a*. For example, a length, width (e.g., impedance) and/or shape (here an upside down L shape) of third delay line 138 can be selected such that it produces an approximately 120° phase shift between the RF signals provided to third signal via 120*c* and first signal via 120*a*. Thus, each of first, second and third signal vias 120*a*-120*c* can be excited with RF signals approximately 120° out of phase relative to an adjacent signal via.

In some embodiments, first, second, and third delay lines 134, 136, 138 can be formed having different lengths, different impedances (e.g., different widths) and/or different shapes. For example, first, second, and third delay lines 134, 136, 138 can be configured to act as an RF choke. The width of first, second and third delay lines 134, 136, 138 can be selected to achieve an appropriate impedance. In some embodiments, first, second, and third delay lines 134, 136, 138 can be selected such that they appear as an open circuit. In the illustrative embodiment of FIG. 3, the properties of first, second and third delay lines 134, 136, 138 can be selected to provide RF signals to each of the three conductors 106*a*-106*c* having equal amplitude but 120° out of phase relative to an adjacent one of conductors 106*a*-106*c*.

It should be appreciated that shapes, impedances, lengths and/or spacing between first, second and third delay lines 134, 136, 138 can vary and can be selected and formed to produce a required phase shift (here approximately 120°) between RF signals provided to different signal vias for a particular application of an antenna element.

Each of conductors 106*a*-106*c* can be coupled to ground plane (e.g., ground plane 108 of FIG. 2) through at least one of ground vias 124*a*-124*c*. For example, and as illustrated in FIG. 3, first ground via 124*a* can couple a surface of first conductor 106*a* to a ground plane, second ground via 124*b* can couple a surface of second conductor 106*b* to the ground plane, and third ground via 124*c* can couple a surface of third conductor 106*c* to the ground plane.

A plurality of leakage vias 122*a*-122*k* can be formed in antenna element 104 to prevent RF leakage through a feed layer, such as the feed layer between feed circuit 130 and conductors 106*a*-106*c*. For example, and as will be described in greater detail with respect to FIGS. 4-5, leakage vias 122*a*-122*k* can be formed in a different layer of antenna element 104 than ground vias 124*a*-124*c* and can form a cavity such that energy is transferred to (e.g., up to) conductors 106*a*-106*c* and doesn't leak through a stripline layer disposed adjacent to the feed layer of antenna element 104. In the illustrative embodiment of FIG. 3, leakage vias 122*a*-122*k* are formed generally in a circular shape, however it should be appreciated that leakage vias 122*a*-122*k* can be formed in a variety of different shapes (e.g., rectangular, spherical, etc.) to prevent leakage. Further, the number of leakage vias 122*a*-122*k* can be selected based at least in part on a dimensions of a respective antenna element and its respective components and/or a frequency of RF signals being provided. For example, in an embodiment, the size of the cavity created by leakage vias 122*a*-122*k* can be used to tune the respective antenna element or array antenna.

Referring now to FIG. 4, conductors 106*a*-106*c* can be formed over a first surface 140*a* of a first dielectric region 140 forming an antenna circuit 150. Feed line 132 and first and second delay lines 134, 135 can be formed within a second dielectric region 142 as part of feed circuit 130. In an embodiment, second dielectric region 142 can be formed proximate to a second surface 108*b* of ground plane 108 (here below ground plane 108) of antenna element 104. Signals vias 120*a*-120*c* can be formed through first dielectric region 140 and a portion of second dielectric region 142 to couple a surface of conductors 106*a*-106*c* to feed line 132. For example, in an embodiment, antenna circuit 150 is formed adjacent to a first surface 108*a* of ground plane 108 (here above ground plane 108) and feed circuit 130 is formed adjacent to second surface 108*b* of ground plane 108 (here below ground plane 108).

In the illustrative embodiment of FIG. 4, first signal via 120*a* extends from first conductors 106*a* to a first antenna port 121*a*, second signal via 120*b* extends from second conductors 106*b* to a second antenna port 121*b*, and third signal via 120*c* extends from third conductor 106*c* to a third antenna port 121*c*. In an embodiment, each of first, second and third antenna ports 121*a*-121*c* can be part of the signal path for antenna element 104. For example, each of first, second and third antenna ports 121*a*-121*c* can be coupled to feed line 132 to provide RF signals to first, second and third signal vias 120*a*-120*c*, respectively. In some embodiments, first antenna port 121*a* can be coupled to the second region 138 of second delay line 135 to receive RF signals, second port 121*b* can be coupled to the first delay line 134 to receive RF signals and third antenna port 121*c* can be capacitively coupled to feed line 132 to receive RF signals. In an embodiment, first, second and third antenna ports 121*a*-121*c* may optionally include impedance tuning features (e.g., copper etched pads) added in some embodiments to improve loss performance.

As illustrated in FIG. 4, ground vias 124*a*-124*c* can be formed through first dielectric region 140 to couple a surface of conductors 106*a*-106*c* to ground plane 108. Second dielectric region 142 is below second surface 108*b* of ground plane 108. Leakage vias 122*a*-122*k* can be formed within second dielectric region 142. In some embodiments, leakage vias 122*a*-122*k* can be formed through second dielectric region 142 such that they extend from ground plane 108 to an additional ground plane formed proximate to a second surface 142*b* of second dielectric region 142.

Figure 5:
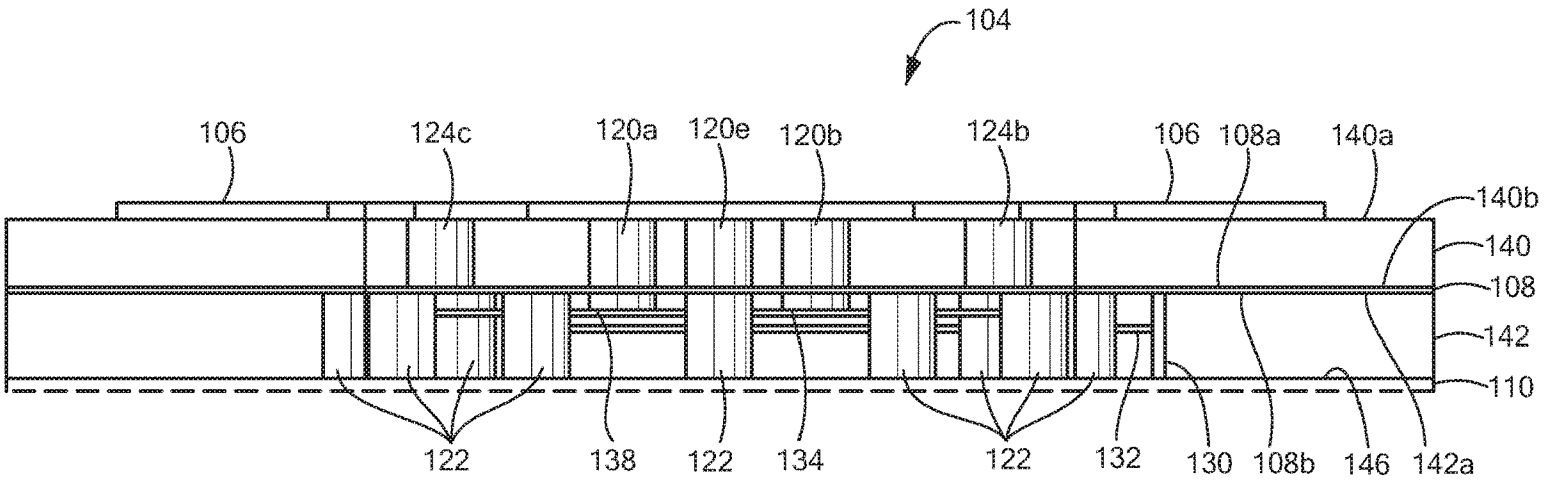
FIG. 5 is a side view of the antenna element of FIG. 3.

For example, and referring now to FIG. 5, a second ground plane 110 can be formed proximate to (here under) a second surface 142*b* of second dielectric region 142. Further, and as illustrated in FIG. 5, leakage vias 122*a*-122*k* can be formed to couple a surface of first ground plane 108 to a surface of second ground plane 110. Thus, leakage vias 122*a*-122*k* can form a cavity proximate to (here under) couplings between signals vias 120*a*-120*c* can conductors 106*a*-106*c* to prevent leakage.

In the illustrative embodiment of FIG. 0.5, conductors 106*a*-106*c* are disposed proximate to a first surface 140*a* of first dielectric region 140. Signal vias 120*a*-120*c* extend from a surface of conductors 106*a*-106*c* to feed line 132 and delay lines 134, 136, 138 and thus through first dielectric region 140 and a portion of second dielectric region 142. For example, signal vias 120*a*-*c* can extend through first dielectric region 140 and a portion of second dielectric region 142 to couple to components of feed circuit 130, described above. In some embodiments, one or more openings may be formed in ground plane 108 such that signal vias 120*a*-120*c* can extend through and couple to delay lines 134, 136, 138, respectively.

Ground vias 124*a*-124*c* extend from a surface of conductors 106*a*-106*c* to ground plane 108.

Figure 6:
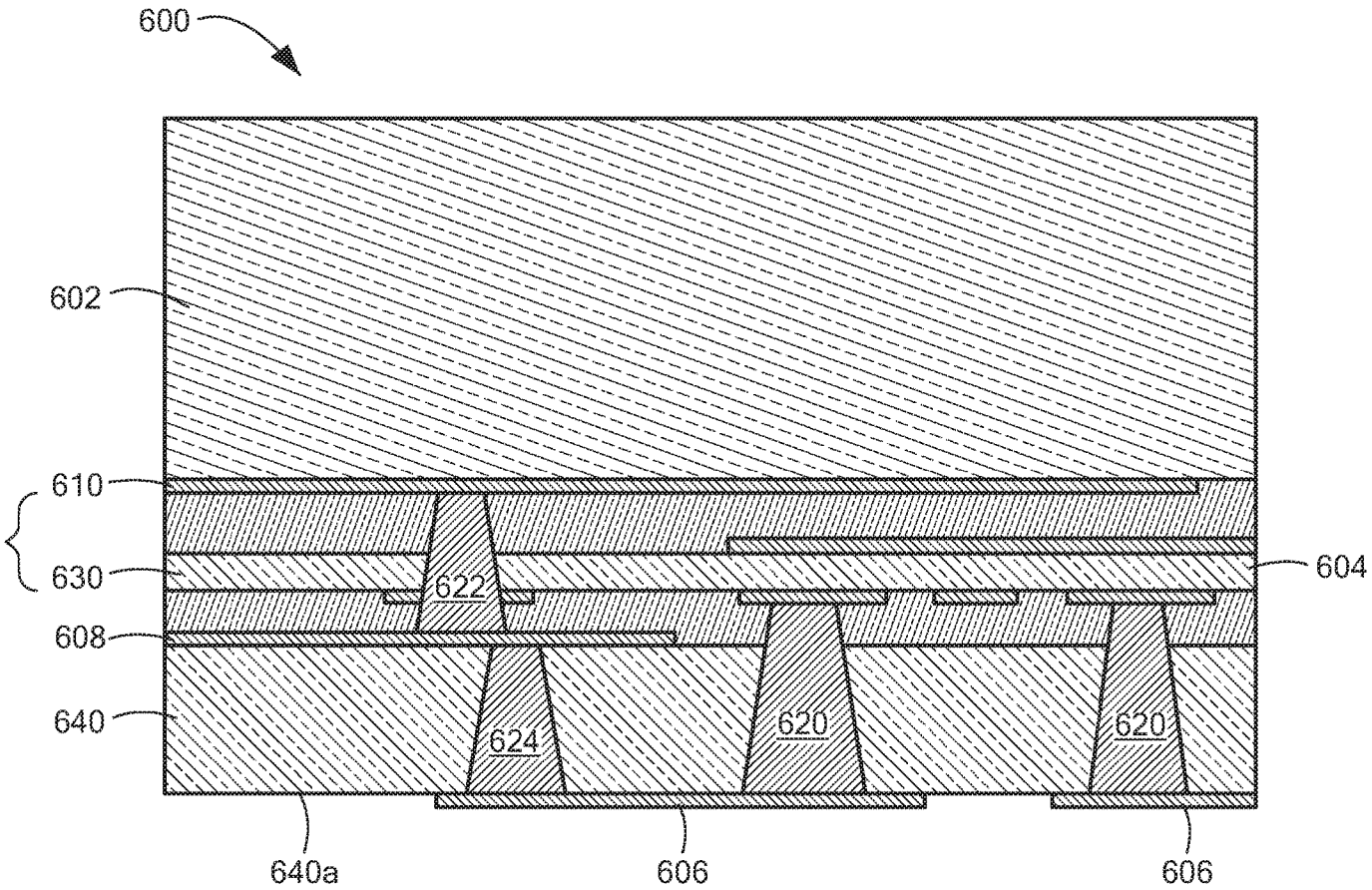
FIG. 6 is a cross-sectional view of an antenna element which may be the same as or substantially similar to the antenna element of FIG. 3 coupled to a manifold.

Referring now to FIG. 6, a structure 600 having a manifold 602 coupled to an antenna element 604. In an embodiment, antenna element 604 may be the same as or substantially similar to antenna element 104 as described above with respect to FIGS. 1-5. In some embodiments, structure 600 may include a printed wiring board (PWB) stack up having manifold 602 and antenna element 604 and power and control layers support active devices.

Manifold 600 may include circuitry operable to couple or otherwise convey an electrical signal (e.g., RF signal) to antenna element 604 or an array antenna having a plurality of antenna elements 604.

In the illustrative embodiment of FIG. 6, antenna element 604 includes conductors 606 formed on a first surface 640*a* of a first layer 640. Conductors 606 can be coupled to a first ground plane 608 through one or more ground vias 624. Conductors 606 can be coupled to a feed circuit 630 through one or more signal vias 620.

Ground plane 608 is generally disposed between first dielectric region 640 and a second layer dielectric region 642 of antenna element 604. Feed circuit 630 may include a feed line, one or more delay lines, a signal port and antenna ports to provide RF signals to conductors 660. Feed circuit 630 be formed within second layer 642. One or more leakage vias 622 can be formed such that they extend from first ground plane 608 to a second ground plane 610. In some embodiments, second ground plane 610 may be a component of manifold 602. In other embodiments, second ground plane 610 may be formed as a component of antenna element 620.

Having described preferred embodiments, which serve to illustrate various concepts, structures and techniques, which are the subject of this patent, it will now become apparent that other embodiments incorporating these concepts, structures and techniques may be used. Accordingly, it is submitted that the scope of the patent should not be limited to the described embodiments but rather should be limited only by the spirit and scope of the following claims.

What is claimed:

1. A radio frequency (RF) antenna element comprising:

a substrate having first and second opposing surfaces;

three conductors disposed on the first surface of said substrate, said three conductors being physically spaced apart from each other and being arranged so as to form an antenna element responsive to RF signals at a desired frequency range; and a feed circuit having a signal port, and first, second and third antenna ports, each of the first, second and third antenna ports coupled to a respective one of the three conductors through a respective one of three signal vias;

a first ground via extending from a first conductor of the three conductors to a ground plane, a second ground via extending from a second conductor of the three conductors to the ground plane and a third ground via extending from a third conductor of the three conductors to the ground plane; and wherein said feed circuit is configured such that in response to an RF signal provided to the signal port thereof, said feed circuit provides at each of the first, second and third antenna ports, RF signals having equal amplitudes and phases shifted by 120 degrees.

2. The antennal element of claim 1, wherein the three conductors have the same geometric shape.

3. The antenna element of claim 1 wherein the ground vias form a grounded structure where the entire radiator circuit is DC grounded thereby improving high frequency performance and inhibiting propagation of surface waves.

4. The antenna element of claim 1 wherein said conductors are provided having a size for operation in the Q-band frequency range.

5. The antenna element of claim 1, wherein the ground plane corresponds to a first ground plane and the antenna element further comprises a plurality of leakage vias disposed having a geometric relationship with respect to each other, each of the plurality of leakage vias coupling the first ground plane to a second ground plane.

6. The antenna elements of claim 5, wherein the antenna element comprises two layers such that the three conductors are disposed in a first layer and the plurality of leakage vias are disposed in a second layer.

7. The antenna element of claim 1, wherein the feed circuit further comprises a feed line coupling the signal port to the second signal via, wherein the feed line provides the RF signals to each of the first, second and third signal vias having equal amplitudes and having a 120 degree phase shift relative to the RF signals provided to an adjacent one of the first, second and third signal vias.

8. The antenna element of claim 1, further comprising a first delay line having a first length, a second delay line having a second length, and a third delay line having a third length, wherein the first delay line couples the first ground via to the first signal via and the second delay line couples the second ground via to the second signal via and the third delay line couples the second signal via to the third signal via.

9. The antenna element of claim 8, wherein a portion of the feed line is disposed proximate to a portion of the first delay line to couple the feed line to the first delay line, and wherein the first delay line serves as a ground reference to the feed line.

10. The antenna element of claim 8, wherein the first delay line and second delay line are spaced a predetermined distance from each other, and wherein the predetermined distance produces the 120 degree phase shift between the RF signals provided to the first and second signal vias.

11. The antenna element of claim 10, wherein the predetermined distance is selected such that a combined power factor of the RF signals provided to the second signal via and third via is two times greater than a power factor of the RF signals provided to the first signal via.

12. The antenna element of claim 8, wherein a length of the third delay line is selected to produce the 120 degree phase shift between the RF signals provided to the second signal via and third signal via.

13. The antenna element of claim 1 wherein said conductors are disposed having a triangular lattice spacing.

14. An array antenna comprising:

a substrate having first and second opposing surfaces; and a plurality of antenna elements disposed on the first surface of said substrate, each of the plurality of antenna elements comprising:

three conductors physically spaced apart from each other and arranged so as to be responsive to RF signals at a desired frequency range; and a feed circuit having a signal port, and first, second and third antenna ports, each of the first, second and third antenna ports coupled to a respective one of the three conductors through a respective one of three signal vias, a first ground via extending from a first conductor of the three conductors to a ground plane, a second ground via extending from a second conductor of the three conductors to the ground plane and a third ground via extending from a third conductor of the three conductors to the ground plane, wherein said feed circuit is configured such that in response to an RF signal provided to the signal port thereof, said feed circuit provides at each of the first, second and third antenna ports, RF signals having equal amplitudes and phases shifted by 120 degrees.

15. The array antenna of claim 14 where said plurality of antenna elements are disposed having a triangular lattice spacing.

16. The array antenna of claim 14, wherein the ground plane corresponds to a first ground plane and wherein each of the antenna elements further comprises a plurality of leakage vias disposed having a geometric relationship with respect to each other, each of the plurality of leakage vias coupling the first ground plane to a second ground plane.

17. The array antenna of claim 16, wherein each of the antenna elements further comprises two layers such that the three conductors are disposed in a first layer and the plurality of leakage vias are disposed in a second layer.

18. The array antenna of claim 14, wherein each of the antenna elements further comprises a feed line coupling the signal port to the second signal via, wherein the feed line provides the RF signals to each of the first, second and third signal vias having equal amplitudes and having a 120 degree phase shift relative to the RF signals provided to an adjacent one of the first, second and third signal vias.

19. The array antenna of claim 14, wherein each of the antenna elements further comprises a first delay line having a first length, a second delay line having a second length and a third delay line having a third length, wherein the first delay line couples the first ground via to the first signal via, the second delay line couples the second ground via to the second signal via and the third delay line couples the second signal via to the third signal via.

20. The array antenna of claim 19, wherein a portion of the feed line is disposed proximate to a portion of the first delay line to couple the feed line to the first delay line, and wherein the first delay serves as a ground reference to the feed line.

21. The array antenna of claim 19, wherein the first delay line and second delay line are spaced a predetermined distance from each other, and wherein the predetermined distance produces the 120 degree phase shift between the RF signals provided to the first and second signal vias.

22. The array antenna of claim 21, wherein a length of the third delay line is selected to produce the 120 degree phase shift between the RF signals provided to the second signal via and third signal via.

* * * * *